US009272167B2

(12) United States Patent
Smit

(10) Patent No.: US 9,272,167 B2
(45) Date of Patent: Mar. 1, 2016

(54) FALL PROTECTION SYSTEM

(75) Inventor: John Theodore Smit, Fish Hoek (ZA)

(73) Assignee: IMMORTAL HEALTH AND SAFETY SOUTHERN AFRICA (PROPRIETARY) LIMITED (ZA)

( * ) Notice: Subject to any disclaimer, the term of this patent is extended or adjusted under 35 U.S.C. 154(b) by 0 days.

(21) Appl. No.: 13/823,883

(22) PCT Filed: Sep. 16, 2011

(86) PCT No.: PCT/IB2011/054050

§ 371 (c)(1),
(2), (4) Date: May 13, 2013

(87) PCT Pub. No.: WO2012/035514

PCT Pub. Date: Mar. 22, 2012

(65) Prior Publication Data

US 2013/0233648 A1 Sep. 12, 2013

(30) Foreign Application Priority Data

Sep. 17, 2010 (ZA) ..... 2010/06681

(51) Int. Cl.
*E04G 21/32* (2006.01)
*A62B 35/00* (2006.01)
*A62B 1/06* (2006.01)

(52) U.S. Cl.
CPC ..... *A62B 35/0043* (2013.01); *A62B 35/0093* (2013.01); *A62B 1/06* (2013.01); *E04G 21/32* (2013.01); *Y10T 29/49826* (2015.01)

(58) Field of Classification Search
CPC ..... A62B 35/0043; A62B 35/0068; A62B 35/04; A62B 35/0056; A62B 35/0075; A62B 99/00; A62B 1/14; A62B 35/00; A62B 1/06; E04G 21/3261; E04G 21/3295; E04G 21/32; E04G 21/3204
USPC ..... 182/3, 8, 9, 45, 112, 113, 241, 191, 192
See application file for complete search history.

(56) References Cited

U.S. PATENT DOCUMENTS 275,197 A * 4/1883 Griffin ..... 182/50
5,036,949 A * 8/1991 Crocker et al. ..... 182/3

(Continued)

FOREIGN PATENT DOCUMENTS

GB 2269623 A * 2/1994 ..... E04G 21/32
GB 2443620 A * 5/2008 ..... E04G 21/32
WO WO 2006042889 A2 * 4/2006 ..... A62B 35/04

OTHER PUBLICATIONS

International Preliminary Report on Patentability for PCT/IB2011/054050, mailed Aug. 13, 2012, international filing date of Sep. 16, 2011, 8 pages.

(Continued)

*Primary Examiner* — Daniel Cahn
(74) *Attorney, Agent, or Firm* — Cantor Colburn LLP

(57) ABSTRACT

The invention concerns a fall protection system for use when working on an elevated structure. The system includes an anchor rope which is securable on opposite sides of the elevated structure so that the anchor rope extends from one side of the structure to the opposite side of the structure. A safety rope, which is connectable to the anchor rope and to a harness worn by a user, is also provided. The system further includes a rope length adjustment device which is connectable to the safety rope and adapted to allow the safety rope to pass therethrough so that the effective length of safety rope extending between the rope length adjustment device and the anchor rope can be adjusted up to a certain length determined by the user in order to define a safe working area. The anchor rope may be connected to anchor points on the structure by means of belay-fall arrest-descending devices which allows a user to be lowered in a controlled manner down to ground level in the event of a fall occurring. The invention also concerns a method of installing the fall protection system.

3 Claims, 2 Drawing Sheets

(56) References Cited

U.S. PATENT DOCUMENTS

| | | | | |
|---|---|---|---|---|
| 5,219,039 | A * | 6/1993 | Bell | 182/3 |
| 5,522,472 | A * | 6/1996 | Shuman et al. | 182/3 |
| 6,478,111 | B2 * | 11/2002 | Olson et al. | 182/3 |
| 6,520,290 | B1 | 2/2003 | Carter | |
| 6,805,220 | B2 | 10/2004 | Fulton et al. | |
| 2010/0213004 | A1 * | 8/2010 | Petty | 182/5 |
| 2012/0312633 | A1 * | 12/2012 | Massey | 182/3 |

OTHER PUBLICATIONS

International Search Report for PCT/IB2011/054050, mailed Jan. 9, 2012, international filing date of Sep. 16, 2011, 3 pages.

* cited by examiner

FALL PROTECTION SYSTEM

CROSS-REFERENCE TO RELATED APPLICATIONS

This application is a U.S. national stage application of International Application No. PCT/IB2011/054050, which has an international filing date of 16 Sep. 2011, and which claims priority to South African Patent Application No. 2010/06681, filed 17 Sep. 2010.

BACKGROUND OF THE INVENTION

Field of the Invention

This invention relates to a fall protection system. More particularly but not exclusively, to a fall protection system which can be used where a person is required to work at an elevated location, to prevent such a person from falling to the ground in the event that the person falls from such a structure.

The system is designed for users working at elevated positions, particularly low heights such as on top of shipping containers, rail locomotives, tankers and transformers and the likes. It will be appreciated that while working at these elevated locations, there is a great risk that the user may fall resulting in serious injuries or even death.

Typically, the user working at these low heights is dangerously close to the ground, thus in the event that the user falls there is no time to react to prevent the user from falling to the ground. Moreover, overhead structures where the user can anchor him/herself are typically absent. This means that the user cannot anchor him/herself to a suitable fall protection anchorage system to prevent them from falling to the ground in the event of a fall.

Moreover, even if the user is anchored to a fall protection system, conventional fall protection systems will not deploy due to the length of the system versus the fall distance.

It is therefore an object of the present invention to provide a fall protection system for addressing the above problems.

SUMMARY OF THE INVENTION

According to the present invention there is provided a fall protection system for use when working on an elevated structure, the system comprising:

an anchor rope which is securable on opposite sides of the elevated structure so that the anchor rope extends from one side of the structure to the opposite side of the structure;

a safety rope which is connectable to the anchor rope and to a harness worn by a user; and a rope length adjustment device which is connectable to the safety rope and adapted to allow the safety rope to pass therethrough so that the effective length of safety rope extending between the rope length adjustment device and the anchor rope can be adjusted up to a certain length determined by the user, thereby defining a safe working area.

Preferably, the rope length adjustment device is operable between a release position in which it allows free movement of the safety rope relative to the rope length adjustment device, and a restraining position in which it restrains the movement of the safety rope relative to the rope length adjustment device.

More preferably, the rope length adjustment device is in the form of a rope grab device.

The anchor rope may be securable to the structure by means of an anchor arrangement including at least one belay-fall arrest-descending device.

Preferably, the anchor rope is securable to the structure by means of the anchor arrangement on both sides of the structure, thereby using belay-fall arrest-descending devices on both sides of the structure to secure the anchor rope.

The anchor arrangement may include an anchor sling or strop for connecting the belay-fall arrest-descending device to an anchor point.

The system may also include a temporary support line which is connectable to the structure and which provides a suitable anchor point to which the anchor rope may be attached when the support line is connected to the structure.

Preferably, a knot is provided in the anchor rope for connecting the safety rope to the anchor rope. More preferably, the knot is an alpine butterfly knot.

Advantageously the safety rope is attached to the knot using a hangman's knot and a fall arrest connector.

The system may include at least two protective sleeves for protecting the anchor rope in the regions in which it runs over edges of the structure.

According to another aspect of the present invention there is provided a method of installing a fall protection system on an elevated structure, the method including the steps of:

providing an anchor rope an anchor rope which is securable on opposite sides of the elevated structure so that the anchor rope extends from one side of the structure to the opposite side of the structure;

dividing the anchor rope into two sections by providing an anchor point in the anchor rope between the two sections;

connecting a belay-fall arrest-descending device to each of the sections of the anchor rope;

connecting a safety rope to the anchor point provided in the anchor rope;

attaching a rope length adjustment device to the safety rope;

throwing one of the sections of the anchor rope and the associated belay-fall arrest-descending device over the structure; and securing the belay-fall arrest-descending devices on each section of the anchor rope to the structure on opposite side thereof.

The step of securing the belay-fall arrest-descending devices on each section of the anchor rope to the structure may include the steps of:

connecting an anchor sling to each of the belay-fall arrest-descending devices; and connecting the anchor slings to anchors points on the structure.

The method of installing the system may further include the steps of:

providing a temporary anchor line on the structure; and securing the anchor rope to the temporary anchor line instead of anchor points on the structure.

BRIEF DESCRIPTION OF THE DRAWINGS

A preferred embodiment of the invention is described by way of a non-limiting example, and with reference to the accompanying drawings in which.

DETAILED DESCRIPTION OF INVENTION

Figure 1:
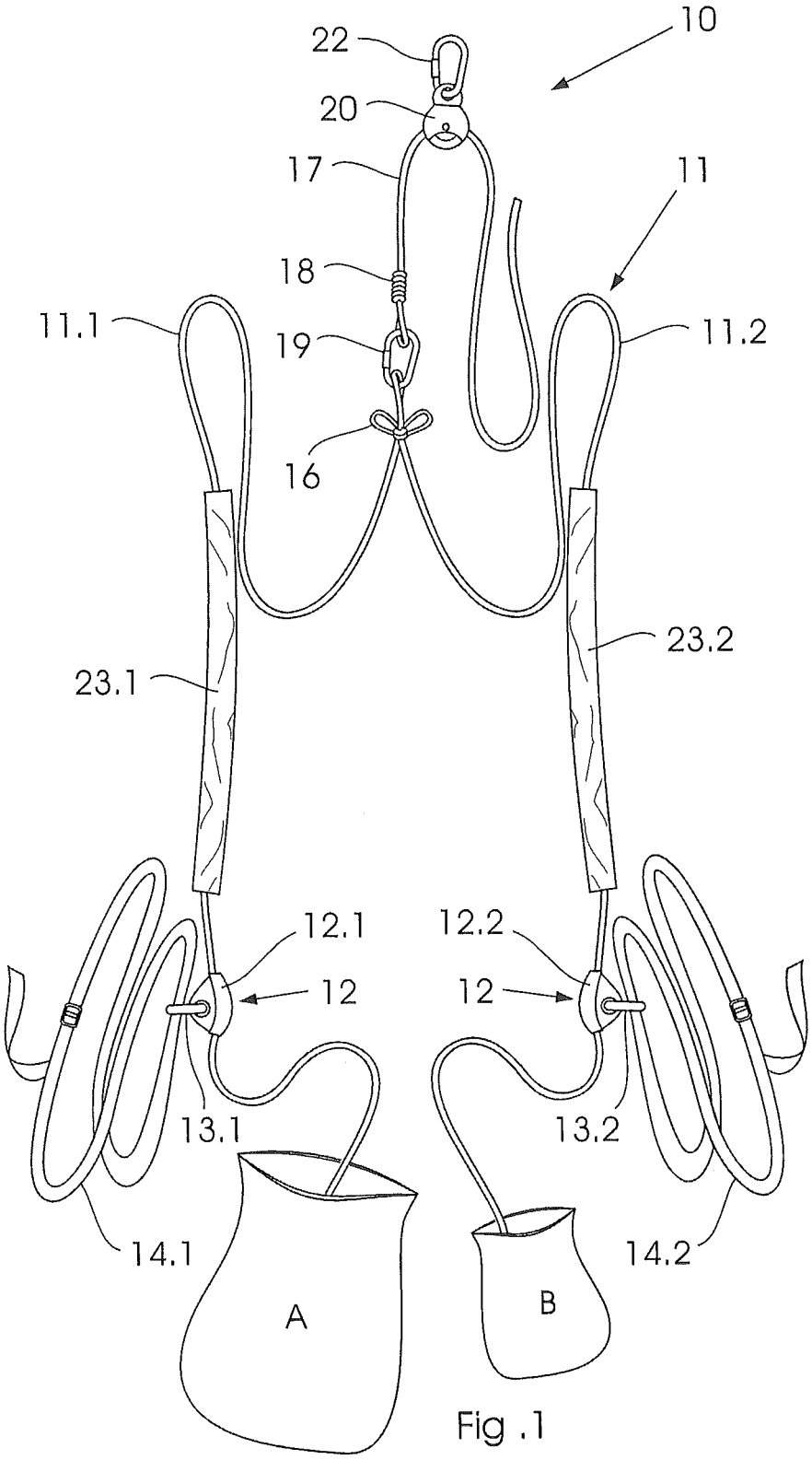
FIG. 1 shows a fall protection system in accordance with the present invention.

Referring to the drawings, in which like numerals indicate like features, a non-limiting example of a fall protection system in accordance with the invention is generally indicated by reference numeral 10.

FIG. 1 shows various the components of the fall protection system 10. The fall protection system 10 can be used on a structure 100 (FIG. 2) where a user would be required to work at an elevated location, to prevent such person from falling to the ground in the event that the person falls from such a structure 100. The structure 100 may for example be the top of shipping containers, rail locomotives/coaches, tankers, transformers and the like. Some components of the embodiment of the invention illustrated in FIGS. 1-3 are provided in pairs and are referred to either jointly by an integer part number, e.g., "12", or individually by corresponding decimalized part numbers, e.g., 12.1, 12.2.

Figure 2:
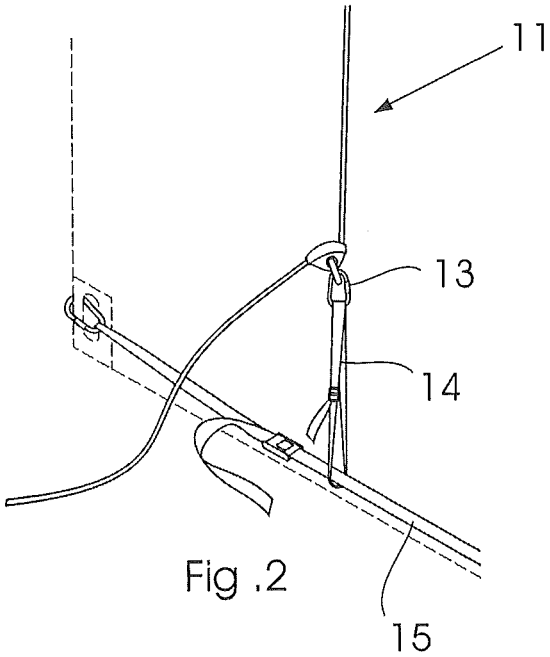
FIG. 2 shows an exploded view of an example of a method of securing the fall protection system of the present invention.
Figure 3:
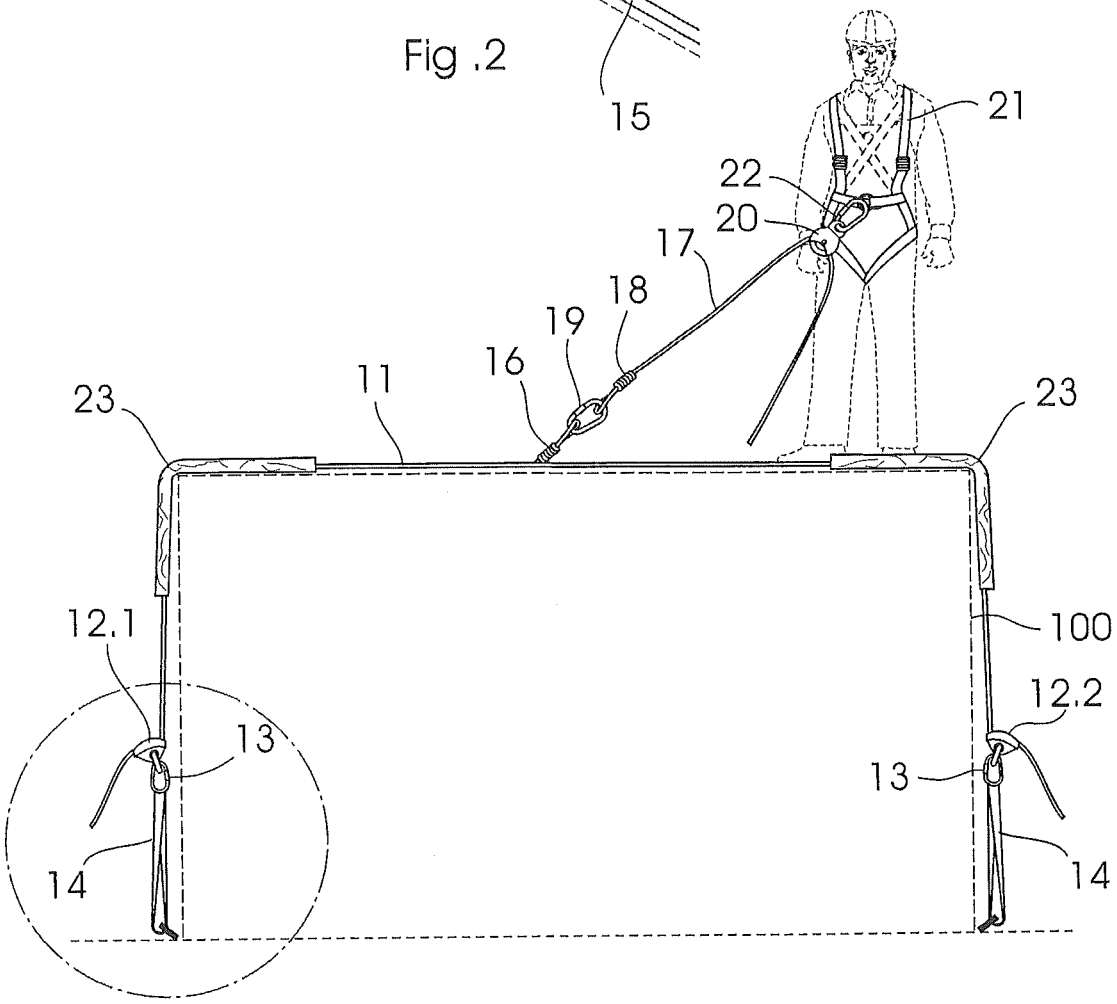
FIG. 3 shows a schematic representation of the fall protection system of FIG. 1.

The fall protection system 10 includes an anchor rope 11 which is securable on opposite sides of the structure 100 so that the anchor rope 11 extends from one side of the structure 100 to the opposite side of the structure 100. The anchor rope 11 is securable to the opposite sides of the structure 100 by means of an anchor arrangement including a belay-fall arrest-descending device 12, a karabiner 13 and an anchor sling or strop 14. At each end of the anchor rope 11 there is provided the belay-fall arrest-descending device 12 to which is connected the anchor sling 14 by means of the karabiner 13. The anchor sling 14 is attached to a designated anchor point of the structure 100.

Where there is no designated anchor point provided on the structure 100 itself, the anchor sling 14 can be attached to a temporary horizontal support line 15 as shown in FIG. 2. It will be appreciated however that the karabiner 13 or anchor sling 14 can be attached directly to any reliable anchor point.

The belay-fall arrest-descending devices 12 on opposite ends of the anchor rope 11 are configured to allow the tightening of the anchor rope 11 by pulling the anchor rope 11 through the belay-fall arrest-descending device 12 in one direction, and by preventing the movement of the anchor rope 11 relative to the belay-fall arrest-descending device 12 in the opposite direction.

Preferably, the anchor rope 11 comprises two ropes 11.1 and 11.2 which are attached to one another through an alpine butterfly knot 16. The alpine butterfly knot 16 is located approximately midway between the two anchor ropes 11.1 and 11.2 and acts as an anchor point for attaching a safety rope 17. The safety rope 17 is shorter in length than the anchor rope 11 and is connected to the alpine butterfly knot 16 by means of a hangman's knot 18 and a delta fall arrest link 19. The safety rope 17 can be of a different colour from the anchor rope 11 so that the two ropes can be differentiated from one another.

A rope length adjustment device 20 is mounted to the safety rope 17. The rope length adjustment device 20 is configured such that the safety rope 17 is allowed to pass through the rope length adjustment device 20 so that the length of safety rope extending between the rope length adjustment device 20 and the anchor rope 11 can either be shortened or lengthened. The rope length adjustment device 20 allows a user to determine the effective length of the safety rope which will allow the user freedom of movement to perform task safely, but which will limit his movements to a safe working area.

The rope length adjustment device 20 is operable between a release position in which it allows the safety rope 17 to pass through the rope length adjustment device 20, and a restraining position in which it restrains the movement of the safety rope 17 relative to the rope length adjustment device 20. The rope length adjustment device 20 as described above is commonly referred to as a rope grab device in the industry.

Typically the rope grab device 20 will be locked in the restraining position once the user has determined a rope length which will allow him to work safely on the elevated location. Should however the user forget to place the rope grab device 20 in the restraining position, the rope grab device 20 is configured such that it will restrict the movement of the safety rope 17 in relation to the pulling force exerted on the safety rope 20 which causes the safety rope 20 to pass quickly through the rope grab device 20. In other words, the higher the pulling force exerted on the safety rope 17, the more the rope grab device 20 restricts the movement of the safety rope 17. This characteristic of the rope grab device 20 ensures that the user will be caught in the event that a quick pulling force is exerted on the safety rope 17 which will cause the safety rope 17 to move too quickly through the rope grab device 20, and thus cause the rope grab device 20 to restrict the movement of the safety rope 17.

The rope grab device 20 is connected to a harness 21 worn by the user via a karabiner 22.

The fall protection system 10 furthermore includes at least two protective sleeves 23 for protecting the anchor rope 11 in the regions in which the anchor rope 11 runs over the sharp edges of the structure 100. The sleeves 23 ensure that the life expectancy of the anchor rope 11 is increased by protecting the anchor rope 11 against cuts by the sharp edges of the structure 100. In use, the anchor rope 11 runs through the protective sleeves 23 so that the sleeves 23 (23.1, 23.2) can be displaced along the length of the anchor rope 11 and into desired positions at the edges of the structure 100. It should be noted that the number of sleeves used is dependent on the type of structure on which the fall protection system 10 is installed.

The process of installing the safety system 10 on the structure 100 will now be described in detail. Many of the advantages of the system 10 will be apparent when considering the installation process.

Advantageously, the fall protection system comes as a kit and the components of the kit are provided in two bags A and B.

The first bag A, which incidentally is the larger of the two bags, is to contain a section of the anchor rope 11.1, a belay-fall arrest-descending device 12.1, a round sling 14.1, the safety rope 17 to be used, two karabiners 13.1 and 22, and the rope grab device 20.

The second bag B will contain the other section of the anchor rope 11.2, the belay-fall arrest-descending device 12.2, the round sling 14.2 and the karabiner 13.2.

Before installing the safety system 10 on the roof it is necessary to connect the various components of the system to one another. The anchor ropes 11.1 and 11.2 are connected to one another to form the anchor rope 11. An alpine butterfly knot 16 is formed at the junction where the two anchor ropes 11.1 and 11.2 meet. The sleeves 23.1 and 23.2 are located over the anchor rope 11 and the belay-fall arrest-descending devices 12.1 and 12.2 are connected at each opposite end of the anchor rope 11. The karabiners 13.1 and 13.2 are used to connect the round slings 14.1 and 14.2, and belay-fall arrest-descending devices 12.1 and 12.2 to one another. The delta fall arrest link 19 connects the safety rope 17 to the alpine butterfly knot 16, and the karabiner 22 connects the safety rope 17 and the rope grab device 20 to the harness 21.

Once these components have been connected to one another the user must throw the smaller bag B over the structure 100 to land on the opposite side of the structure 100. It is pointed out that the reason for including the smaller bag B in this kit is to protect its contents of the bag when throwing the kit over structure 100. The bag B is also used for storing excess rope after the anchor rope 11 is properly fitted and connected. It must be noted that bag B may be designed with additional padding and a closure to protect the contents from damage and falling out.

From this position, the anchor rope 11 and its belay-fall arrest-descending devices 12.1 and 12.2 must be attached via its round slings 14.1 and 14.2 if identified anchorage are too small for the karabiners 13.1 and 13.2. Alternatively the anchor rope 11 can be attached to avian identified anchor points to create a temporary lifeline.

The belay-fall arrest-descending devices 12.1 and 12.2 on opposite ends of the anchor rope 11 are then tightened by pulling the anchor rope 11 through the belay-fall arrest-descending device 12.1 in one direction, and by preventing the movement of the anchor rope 11 relative to the belay-fall arrest-descending device 12.2 in the opposite direction. With the anchor rope 11 in place, the user attaches his harness 21 (FIG. 3) to the rope grab device 20 and can safely ascend via a ladder up the side of the structure 100 to perform the task set. Typically, the means of access will be portable ladders.

Advantageously, the fall protection system 10 of the present invention provides for the alpine butterfly knot 16 to be placed approximately at the centre of the structure 100, which is connected to the safety rope 17, thus offering an overhead anchor which is rigged up before the user accesses the elevated position from the ground. The fall protection system 10 thus protects the user in the event that the user slips whilst ascending to the elevated position to rig up the system in the first place. The design of the system makes it possible to pull the safety rope 17 anchorage to the anchor rope 11 to the highest and central point of the structure 100 above, yet allowing for the safety rope 17 to be available to the user from the ground for protecting the user while ascending and descending from the structure 100.

Once on top of the structure 100, the user can dictate the amount of free rope needed to perform the task, by adjusting the rope grab device 20 to allow sufficient space for free movement, but still limiting the user to the set working area without fear of falling over the side.

Should a fall occur, and the user of the system is hanging against the side of the structure 100 on which he was performing his/her task, all that is needed to lower the user to safety is releasing the anchor rope, by controlling the descending function of belay-fall arrest-descending device 12 on the opposite end from which the user is hanging down. This slowly releases tension on the anchor rope 11, giving slack, and lowers the user to the ground.

The rescuer has no need for any special equipment as the belay-fall arrest-descending device 12 will be about hip height from the ground and easy to operate.

The invention thus provides a fall protection system which can be used to decrease the risk of falling to the ground when performing tasks at elevated positions.

It will be appreciated that the above is only one embodiment of the invention and that there may be many variations without departing from the spirit and/or the scope of the invention.

The invention claimed is:

1. A method of installing a fall protection system on an elevated structure, the method including the steps of:

providing an anchor rope which is securable on opposite sides of the elevated structure so that the anchor rope extends from one side of the structure to the opposite side of the structure;

dividing the anchor rope into two sections by providing an anchor point in the anchor rope between the two sections;

connecting a belay-fall arrest-descending device to each of the sections of the anchor rope;

connecting a safety rope to the anchor point provided in the anchor rope;

attaching a rope length adjustment device to the safety rope;

throwing one of the sections of the anchor rope and the associated belay-fall arrest-descending device over the structure;

securing the belay-fall arrest-descending devices provided on each section of the anchor rope to the structure on opposite sides thereof; and tightening the anchor rope by pulling it through at least one of the belay-fall arrest-descending devices before ascending to the top of the elevated structure.

2. A method according to claim 1, wherein the step of securing the belay-fall arrest-descending devices on each section of the anchor rope to the structure includes the steps of:

connecting an anchor sling to each of the belay-fall arrest-descending devices; and connecting the anchor slings to anchor points on the structure.

3. A method according to claim 1, including the steps of:

providing a temporary anchor line on the structure; and securing the anchor rope to the temporary anchor line instead of anchor points on the structure.

* * * * *